United States Patent [19]

Moore, Jr. et al.

[11] 4,270,894

[45] Jun. 2, 1981

[54] COMBINATION FLUE AND VENT DAMPER

[75] Inventors: Henry J. Moore, Jr., Los Angeles; Myron E. Deneau, Malibu, both of Calif.

[73] Assignee: Mor-Flo Industries, Inc., Santa Monica, Calif.

[21] Appl. No.: 45,084

[22] Filed: Jun. 4, 1979

[51] Int. Cl.[3] ..... F23N 3/00

[52] U.S. Cl. ..... 431/20; 126/293; 126/307 A; 236/45; 236/1 G

[58] Field of Search ..... 126/307 A, 312, 292, 126/285 A, 288, 293; 98/117; 236/45, 1 G; 431/20

[56] References Cited

U.S. PATENT DOCUMENTS

| | | | |
|---|---|---|---|
| 1,943,342 | 1/1934 | Mortimer | 236/45 |
| 1,946,568 | 2/1934 | Butler et al. | 236/45 |
| 1,963,073 | 6/1934 | Butler | 236/45 |
| 2,113,440 | 4/1938 | Cole | 236/45 |
| 2,296,410 | 9/1942 | Wetzsteon | 236/45 |
| 2,743,056 | 4/1956 | Hubbard | 236/45 |
| 2,761,494 | 9/1956 | Field | 236/45 |
| 3,934,796 | 1/1976 | Smith, Jr. et al. | 431/20 |
| 4,079,884 | 3/1978 | Sherman | 236/1 G |

*Primary Examiner*—James C. Yeung
*Attorney, Agent, or Firm*—Ralph B. Pastoriza

[57] ABSTRACT

A housing structure with a single pivoted damper member is provided as a replacement for the draft hood associated respectively with the flue outlet and vent pipe inlet in a gas heater system. The normal flue outlet for the gas system connects to a first passage in the housing and the normal overhead vent inlet connects to a second passage in the housing above the first passage. First ends of the passages adjacent to their connections to the flue outlet and vent pipe inlet are closed off and second ends open out in a common plane. Communicating with the second ends is an ambient atmosphere opening so that under conditions where the second ends of the passages are open, proper exhausting of gases passing up through the flue to the vent takes place. The single damper itself is mounted to swing in a manner to close off both passages simultaneously when in a first position and also isolate these passages from the ambient atmosphere inlet. In this first position, heat is retained in the heater as well as the room. When the damper member is swung to a second position, the ends of both passages are simultaneously opened so as to be in communication with each other as well as the ambient atmosphere opening.

3 Claims, 3 Drawing Figures

COMBINATION FLUE AND VENT DAMPER

This invention relates generally to gas heating systems and more particularly to a novel damper system for flue and vent passages.

BACKGROUND OF THE INVENTION

In gas heater systems such as a hot water tank heating system, there is normally provided a flue outlet pipe extending into an overhead draft hood with a venting pipe passing up through the ceiling or roof of a room containing the system. Normally, a damper is provided for the overhead venting pipe to prevent heated air in a room from escaping through the vent pipe when the vent pipe is not being used to exhaust gases passing from the flue pipe. Further, the draft hood places the vent pipe in communication with the atmosphere so that when the damper is opened to receive gases from the flue pipe, unexpected downdrafts through the vent pipe in a reverse direction during actual operation of the main heaters can escape to the atmosphere rather than be funneled completely down the flue pipe where it can spread the gas flames and possibly cause a fire.

In addition to the normally provided damper in the vent pipe, it has been proposed to provide a damper in the flue pipe. By closing such a flue pipe damper when the heater is not in operation, heat is retained in the heater system which feature is important in the case of a hot water tank heater for optimum operating efficiency. Such second dampers in the flue pipe are normally not provided, but constitute custom type installations but have proved to be advantageous. In fact, it has been proposed in prior art to provide an appropriate coupling between the vent pipe damper and the flue pipe damper when added so that both could be operated simultaneously. Actually, however, it would be more desirable if the necessity for two separate dampers, even though operated simultaneously, could be avoided and a single damper suffice for all functions.

BRIEF DESCRIPTION OF THE PRESENT INVENTION

With the foregoing considerations in mind, the present invention contemplates combination flue and vent damper wherein the necessity for two dampers is eliminated and the desired controls are effected by a single damper member.

More particularly, in accord with this invention there is provided a housing defining first and second passages having first ends communicating with the flue outlet from the heater system and the vent pipe inlet, respectively, the second ends of the passages terminating in a common plane short of one end portion of the housing. This one end portion of the housing has a bottom opening communicating with the ambient atmosphere. A single damper member in turn is mounted in the housing and is movable from a closed position lying in the common plane of the second ends of the passages so as to simultaneously close these passages to a second position in which both passages are open to communicate with each other as well as the ambient atmosphere.

BRIEF DESCRIPTION OF THE DRAWINGS

A better understanding of this invention will be had by now referring to a preferred embodiment thereof as illustrated in the accompanying drawings in which.

DETAILED DESCRIPTION OF THE PREFERRED EMBODIMENT

Figure 1:
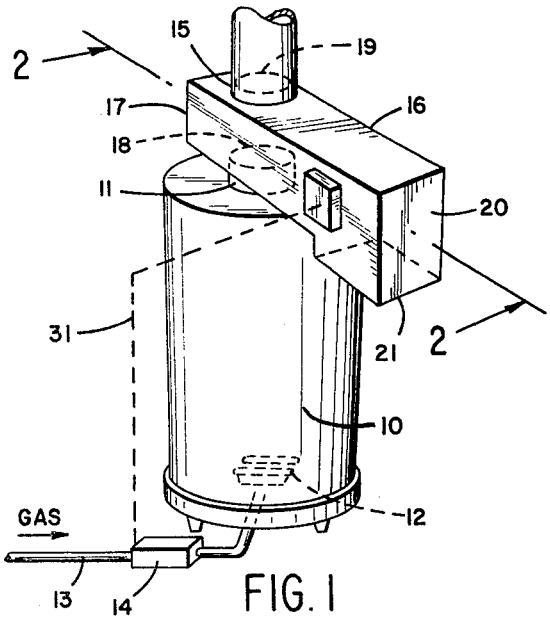
FIG. 1 is a perspective view showing the combination flue and vent damper of this invention on a hot water heater gas system.

Referring first to FIG. 1 there is shown, by way of example, a hot water tank 10 having an upper outlet flue pipe 11 for passing heating gases from a gas burner 12 indicated in phantom lines under the tank 10. An appropriate inlet gas line 13 passes through a gas control valve 14 to the burner 12.

The gas system also normally includes a vent pipe inlet 15 which will pass exhaust gases out through the ceiling or roof of a home.

In conventional arrangements, there is provided a damper for the vent inlet pipe 15 and further a hood arrangement surrounding the vent inlet pipe 15 and overlying the flue outlet pipe 11. This hood is open to the atmosphere so that any downdrafts in the vent pipe will not be confined to the flue pipe alone but can spread out into the atmosphere, thereby avoiding risk of spreading the gas flames beneath the burner.

The foregoing arrangement, however, has the disadvantage that it allows stored heat in the system to escape during off burner operation. Thus, even though the damper and the vent pipe may be closed, heat can still escape up through the flue pipe to the atmosphere by way of the hood arrangement.

As mentioned heretofore, it has been proposed to provide a further damper in the flue pipe itself in addition to the normally provided damper in the vent pipe. This flue pipe damper would have the advantage of confining heat within the heater system during off burner operation.

The present invention provides a simple damper arrangement having the advantages of two separate dampers as described above. Still referring to FIG. 1, this new damper system comprises a housing 16 having at one end portion 17 a flue pipe inlet indicated by the phantom line 18 on its underside for connection to the flue pipe outlet 11.

The one end portion 17 also includes on its upper side a vent pipe outlet 19 for connection with the vent pipe inlet 15.

The housing structure 16 extends generally in a horizontal direction as shown, a second end portion 20 including an ambient atmosphere inlet opening 21 on its underside.

Figure 2:
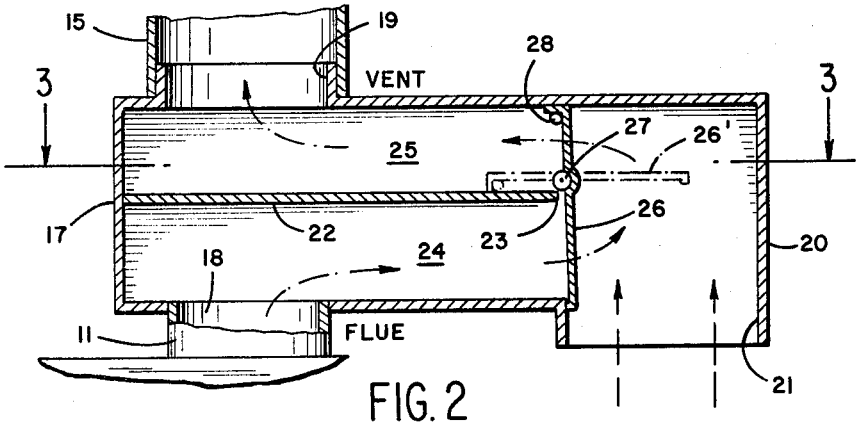
FIG. 2 is an enlarged cross section taken in the direction of the arrows 2—2 of FIG. 1 showing the damper in a closed position in solid lines and in an open position in phantom lines and, FIG. 3 is a top cross sectional view taken in the direction of the arrows 3—3 of FIG. 2 useful in explaining further features of the invention.

Referring to the enlarged fragmentary cross section of FIG. 2, there is incorporated in the housing a horizontal partition 22 extending from the one end 17 of the housing and terminating short of the other end as at point 23. This partition essentially divides the one end portion of the housing into lower and upper duct passages designated generally by the numerals 24 and 25.

The system is completed by the provision of a single damper member 26 pivoted for swinging movement about a horizontal pivot axis 27 to the housing 16. In the solid line position illustrated in FIG. 2, this damper member is in a first closed position wherein it lies generally in a vertical plane normal to the extending end of the partition 22 thereby closing off both ends of the lower and upper duct passages 24 and 25. It will also be noted that this damper member 26 in the closed first position shown isolates the passages 24 and 25 from the ambient atmosphere communicating with the housing through the underside opening 21.

Still referring to FIG. 2, there is depicted by the dashed lines a second position on the damper 26, this second position being indicated at 26' wherein the damper has been moved to a second generally horizontal position to place the flue outlet and vent inlet passages 24 and 25 in communication with each other and also both passages in communication with the ambient atmosphere through the underside opening 21.

When the damper is in the second open position indicated at 26', the flow of flue gases from the flue outlet pipe 11 to the vent inlet pipe 15 is indicated by the dashed arrows. Also, it will be noted that ambient atmosphere can pass up through the opening 21 and thence out the vent outlet pipe 15 as occurs with normal venting systems.

Finally, it will be appreciated that with the system of FIG. 2, when the single damper 26 is in the first closed position, not only is heat retained in the heater system from escaping through the flue pipe, but the vent outlet is also closed so that heated air in a room is prevented from escaping.

When in the second open position indicated by the phantom lines, there is, as pointed out heretofore, communication with the atmosphere through the bottom opening 21 so that down drafts through the vent pipe are not all confined to the flue but can pass to the atmosphere, thus minimizing any risk of spreading the flames underneath a tank.

Operation of the single damper member 26 is normally effected by a solenoid which can be controlled by an appropriate thermostat. However, it is always desirable in the event of failure of power or the like to provide a fail safe condition; that is, in the absence of any controls, it is best to have the flue in an open position. Towards this end, there is as schematically illustrated in FIG. 2, a weight 28 secured to an upper end portion of the damper 26 slightly to the left of the horizontal axis 27 so that a biasing force by gravity is exerted on the damper tending to cause it to flop to its horizontal open position. It should further be noted in FIG. 2 that when the damper is in the horizontal open position, the distance between the end of the partition 23 and the end wall 20 of the housing is greater than the distance between an end of the damper and the pivot axis 27 so that when in the horizontal second position, atmosphere air as well as flue gases can pass around the damper and out the vent pipe.

Figure 3:
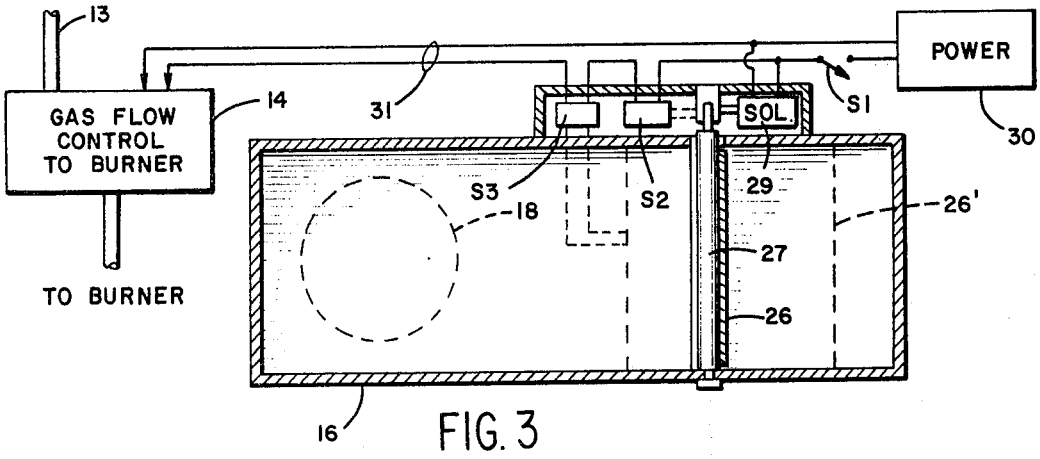

Referring now to FIG. 3, there is shown a further safety feature of the present invention. In FIG. 3, there is schematically indicated at 29 the solenoid control for the single damper 26, the solenoid 29 serving to rotate a pivot shaft lying on the pivot axis 27. Solenoid 29 connects to a power source 30, there being provided a first switch control S1 representing a thermostat which, when closed, will provide power to the solenoid to move the damper to its second horizontal position. When moved to this position, switch S2 will close to apply power to turn on the gas flow control valve 14 by way of electrical leads 31 to provide full gas to the heater. Thus, whenever the damper 26 is moved to its open horizontal position 26', the power effecting this movement is also applied to the gas flow control valve through switch S2 to provide gas to the burner so that heating will take place.

There is always a possibility, however, that even though the switches S1 and S2 are closed, indicating that the damper pivot shaft has been rotated, the damper itself may not actually move to its second position. In order to avoid any accidents by reason of failure of the damper to actually physically open, even though the solenoid is energized, there is, in accord with the present invention, an additional switch indicated at S3 in series with the switch S2 in the power lead passing to the gas flow control 14. Switch S3 is responsive only to physical positioning of the damper 26 to its second horizontal position 26'. In other words, it may take the form of a microswitch having an actuating button which is physically engaged by the damper only when the damper is in its second horizontal position.

When the damper is in the open second horizontal position, switch S3 will be operated to close the circuit and thus the gas flow control valve can pass gas to the burner. Failure of the damper 26 to move to its second open position will prevent operation of the switch S3 and thus block operation of the gas flow control valve.

From all of the foregoing, it will be seen that the present invention has thus provided a greatly improved combination flue and vent damper wherein a single damper control element is all that is necessary to control both the flue and vent pipes. Moreover, appropriate safety features have been incorporated to assure substantially foolproof operation.

We claim:

1. A flue and vent damper in combination with a gas heater system having a gas flow control valve, flue pipe outlet and an overhead vent pipe inlet, including:

(a) a housing having at one end a flue pipe inlet on its underside for connection to said flue pipe outlet and a vent pipe outlet on its upper side for connection to said vent pipe inlet and at its other end, an ambient atmosphere inlet opening on its underside;

(b) a horizontal partition in said housing extending from said one end to pass between said flue pipe inlet and vent pipe outlet and terminating short of said other end of the housing to divide the one end of the housing into lower and upper duct passages;

(c) a single damper member pivoted to said housing for swinging movement from a first closed position in which said damper member is in a generally vertical plane normal to the extending end of said partition to close off the ends of both said lower and upper duct passages so that said flue outlet and vent inlet are isolated from each other and from ambient atmosphere to a second generally horizontal position to place said flue outlet and vent inlet in communication with each other and the ambient atmosphere; and (d) a switch control connected in series with the circuit to said control valve, said switch control being responsive to closing of said damper means to open the circuit to said gas control valve so that no gas can pass through said control valve when said damper member is in said closed position.

2. The combination of claim 1, in which said damper member is pivoted to said housing for swinging movement about an horizontal axis adjacent to and parallel with the extending end edge of said partition, the distance between said edge and the said other end of said housing being greater than the distance between one end of the damper member and its pivot axis so that air can readily pass up through said ambient atmosphere inlet opening and pass said damper member into said upper duct passage when said damper member is in said second generally horizontal position, said damper member having a weight at an extreme end portion biasing by gravity pivoting movement to said second open position.

3. A flue and vent damper in combination with a gas heater system having a gas flow control valve, a flue outlet and a vent pipe inlet above said flue outlet, including:

(a) a housing defining first and second passages having first ends communicating with said flue outlet and vent pipe inlet respectively and second ends terminating in a common plane short of one end portion of the housing, said one end portion having a bottom opening in communication with the ambient atmosphere;

(b) a single damper means mounted on said housing and movable from a closed position lying in said common plane wherein said second ends of said passages are simultaneously closed to isolate said flue outlet and said vent pipe inlet from each other and from the ambient atmosphere, to an open position placing said second ends in communication with each other and said ambient atmosphere; and (c) a switch control for said gas flow control valve connected to said damper means and responsive to closing of said damper means to prevent opening of said gas flow control valve so that gas cannot flow to said heater when said damper means is in said closed position.

* * * * *